United States Patent [19]

Linstromberg

[11] 4,087,140

[45] May 2, 1978

[54] MAGNETIC LATCH - MOVABLE ICE RECEPTACLE

[75] Inventor: William John Linstromberg, Evansville, Ind.

[73] Assignee: Whirlpool Corporation, Benton Harbor, Mich.

[21] Appl. No.: 787,357

[22] Filed: Apr. 14, 1977

[51] Int. Cl.[2] ..... F27C 5/18; A47B 97/00

[52] U.S. Cl. ..... 312/292; 49/70; 62/344; 312/273; 312/138 R

[58] Field of Search ..... 312/292, 242, 273, 138 R, 312/330; 62/344, 377, 382, 459; 49/70

[56] References Cited

U.S. PATENT DOCUMENTS

| | | | |
|---|---|---|---|
| 3,048,462 | 8/1962 | Fisher | 312/214 |
| 3,643,464 | 2/1972 | Milliker et al. | 312/292 |
| 3,883,204 | 5/1975 | Prada et al. | 62/344 |

*Primary Examiner*—Paul R. Gilliam
*Assistant Examiner*—Alex Grosz
*Attorney, Agent, or Firm*—Wegner, Stellman, McCord, Wiles & Wood

[57] ABSTRACT

A cabinet having a storage compartment with an access opening, a door movable about a main axis for exposing and closing the opening, a secondary access opening in this door of smaller extent and having its own door, hinges for each of said doors asymmetrical with and non-parallel to each other and a movable receptacle in the compartment mounted for movement forwardly and rearwardly of the compartment and with means interconnecting the receptacle and the secondary closure member for movement of the receptacle when either of the access doors are opened but with the movement of the receptacle being less when the main access door is opened.

15 Claims, 5 Drawing Figures

MAGNETIC LATCH - MOVABLE ICE RECEPTACLE

BACKGROUND OF THE INVENTION

In cabinets such as a refrigerator cabinet having a freezer compartment for storage of frozen foods it is common practice to provide the freezer compartment with an ice maker for producing bodies of ice and a receptacle in which these ice bodies are collected. It is generally necessary to open the freezer compartment and reach in to remove the ice bodies from the receptacle as needed. This invention provides a structure in which the ice receptacle or the like is moved outwardly into access position when either a small ice access door closing an opening in the large compartment door is opened or when the large door is itself opened. The extent of movement of the receptacle in this latter case is less than the extent of movement when the smaller door is opened. One technique for effecting such operation of an ice receptacle is disclosed in applicant's application, Ser. No. 749536, filed Dec. 10, 1976 entitled "Refrigerator With Movable Ice Receptacle For Improved Ice Acess".

Patents considered during the preparation of this application include U.S. Pat. Nos. 3,883,204; 3,643,464, 3,048,462; 2,864,637 and 2,446,336.

SUMMARY OF THE INVENTION

In this invention a receptacle, such as an ice receptacle, is mounted on guide means in a storage compartment that supports the receptacle for movement along a horizontal path but sustains it against substantial forward tipping, particularly when the receptacle is in its forwardmost position. The main door or closure member which is movable about a main axis exposes and closes the general opening to the compartment itself. Mounted on and forming a part of this main door is a secondary door or closure member movable about its own axis with the axes of the two doors being asymmetric with and non-parallel to each other, such as where the axes are at right angles to each other.

Magnetic means are provided, including an elongated magnet and an elongated magnetic armature that are in full engagement when the secondary door is closed and throughout the extent of its movement when it alone is moved, but which become substantially immediately and progressively disengaged when the main access door is opened. Specifically, by moving one end of the magnet and armature away from each other at an accelerated rate as the main door is opened the magnetic connection is rapidly broken, thus limiting the extent of movement of the receptacle whenever the main door is opened.

DESCRIPTION OF THE PREFERRED EMBODIMENT

Figure 1:
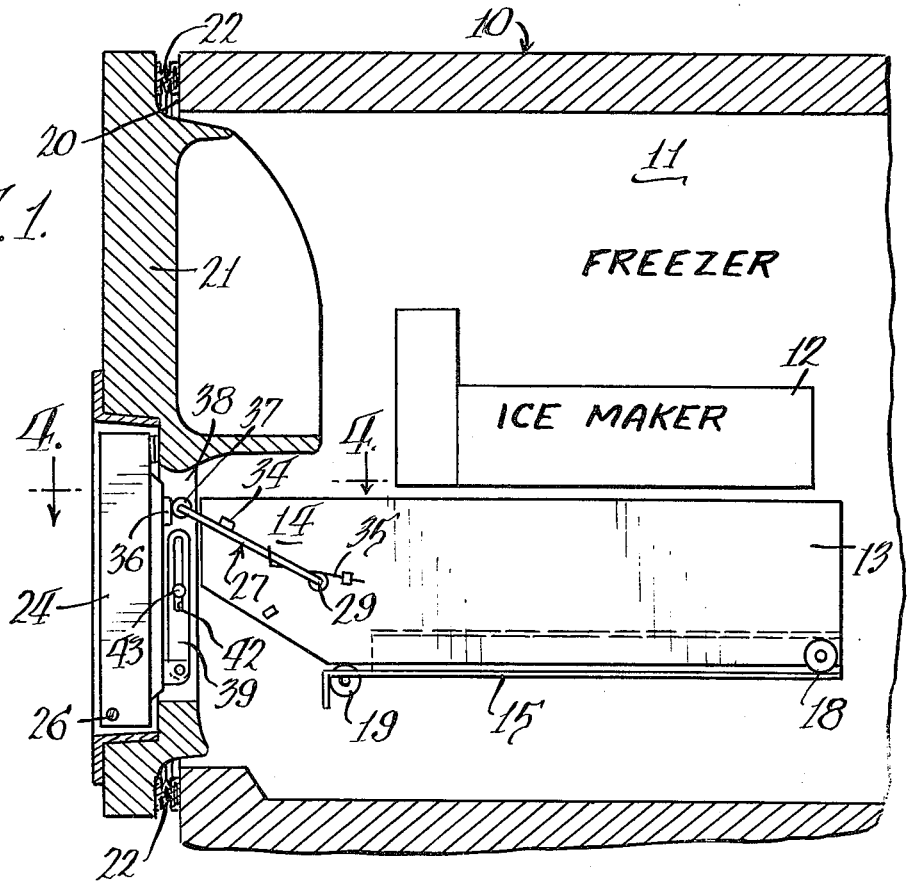
FIG. 1 is a fragmentary vertical sectional view through a refrigeration apparatus embodying the invention having a freezer compartment with an ice maker and receptacle and access doors.

In the embodiment illustrated in the drawings there is provided a cabinet apparatus 10 embodied in a refrigerator including a freezer compartment 11 in which is located a customary ice maker 12 for forming ice bodies such as ice cubes for automatic disposition into an underlying receptacle 13.

The receptacle 13 is provided with a forward portion 14 and is movably mounted upon side tracks 15 in the form of two parallel channels each of which has upper 16 and lower 17 flanges which guide side rear wheels 18 on the receptacle 13. The bottom of the receptacle 13 adjacent the forward portion 14 engages a pair of oppositely located wheels 19 for supporting the bottom of the receptacle 13 in its travel as can be seen by a comparison of FIGS. 1 and 2 which show the innermost and outermost positions of the receptacle.

The compartment 11 has an access opening 20 that is normally closed by a main closure member or door 21 and is sealed thereto by a gasket 22. This door 21 is mounted for opening movement in a horizontal direction by a conventional side hinge (not shown) that is positioned for door movement about a vertical axis.

The main door 21 also has a secondary access opening 23 to the compartment 11 that is much smaller in extent than the main door 21 and that is normally closed by a secondary closure member or door 24 hingedly mounted in the opening 23 about its own or second axis 26. The two axes of movement of the main door 21 and the secondary door 24 are asymmetrical with and non-parallel to each other, in this particular embodiment being at right angles to each other. The main axis is vertical as described and the second hinge axis 26 is essentially horizontal.

The forward portion 14 of the receptacle 13 is interconnected to the secondary door 24 by interconnecting means 27 which in the illustrated embodiment is in the form of a bail having parallel sides 28 with ends 29 embracing and hingedly connected to the rear of the forward portion 14 at points about half-way between the top and bottom of the receptacle 13.

Figure 4:
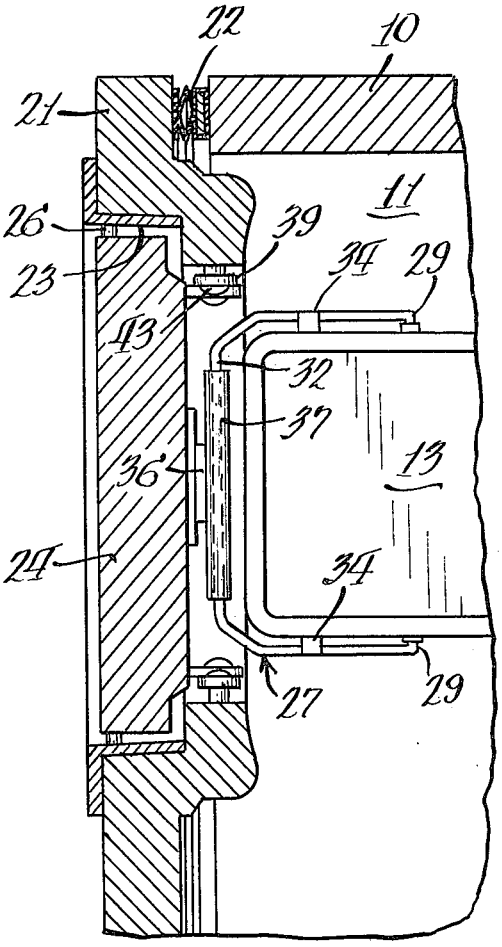
FIG. 4 is an enlarged fragmentary sectional view taken substantially along line 4—4 of FIG. 1 and illustrating the forward portion of the ice receptacle in partial plan view.
Figure 5:
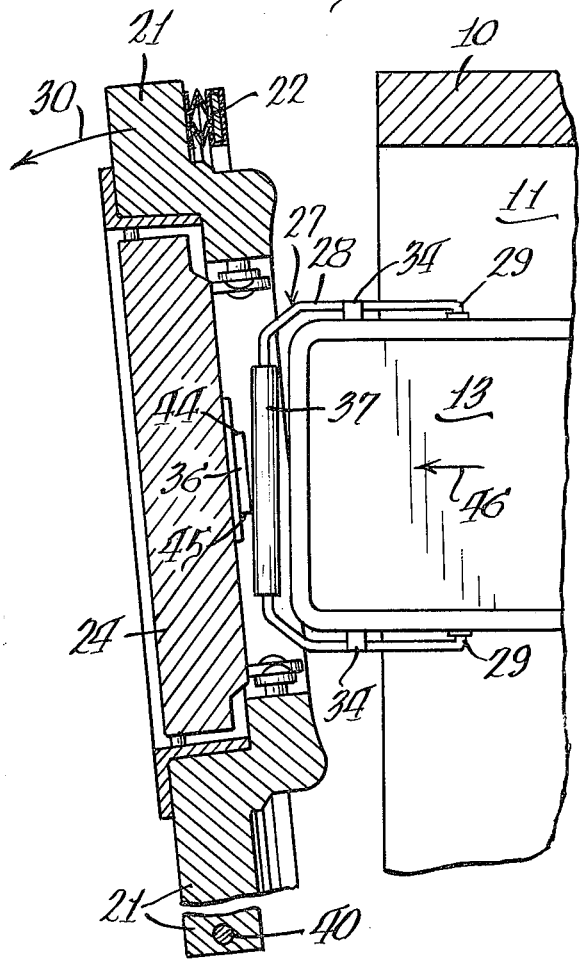
FIG. 5 is a view similar to FIG. 4 but showing the position of the parts after the secondary door has been partially opened and the magnetic connection substantially broken.

This bail 27 provides a handle and has a central horizontal part 32 forwardly of the front end 33 of the receptacle 13 with this horizontal part 32 being substantially parallel to the closed secondary door 24 when the main door is closed, as can be seen, for example in FIG. 4.

The forward portion 14 of the receptacle 13 carries a pair of side stops 34 against which the bail 27 is urged by side springs 35 when the parts are at rest.

The horizontal part 32 of the bail which is adjacent to the rear surface of the secondary door 24 carries an extended tubular magnetic armature 37 which engages a short magnet 36. This magnet 36 is located at the upper portion of the rear surface of the door 24. The lower portion of the door is connected to the sides 38 of the access opening 23 by means of an arm 39, slot 42 and pin 43 connection at each side of the door 24 to give stability to the movement of the door.

Figure 2:
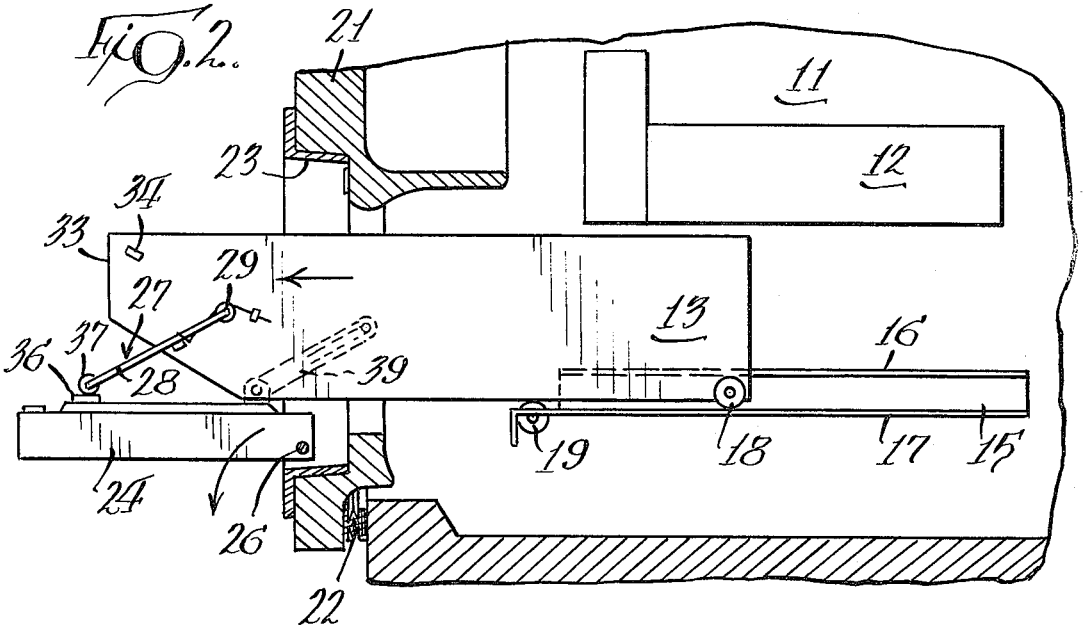
FIG. 2 is a view similar to FIG. 1 but with the secondary door in open position and with the ice receptacle projected to its fullest extent.

With this arrangement, when the door 21 is closed as shown in FIGS. 1 and 4 the ice maker 12 functions in its customary manner to deposit ice bodies or ice cubes into the underlying receptacle 13. Then when it is desired to remove ice from the receptacle the secondary door 24 is moved from the vertical position of FIG. 1 to the outwardly extending forwardmost position of FIG. 2 where the door 24 is essentially horizontal. Because of the magnetic connection of the bail 27 to the door 24 adjacent the top of this door the receptacle 13 rolls out to its forwardmost extended position as shown in FIG. 2. During this movement and corresponding rearward movement to the position of FIG. 1 the magnetic connection of the armature 37 to the magnet 36 remains unbroken.

When the main access door 21 is opened in the customary manner, horizontal arcuate movement as illustrated at 30, about its axis causes the end 44 of magnet 36 to move more rapidly away from the armature 37 than does the other end 45 of the magnet, which is closer to the main door pivot axis 40. This movement causes an immediate breaking of the magnetic attraction between the armature 37 and the magnet 36 so that the receptacle 13 in this instance is moved only a fraction of the distance it could otherwise move, and is immediately returned as soon as the main access door is closed.

Figure 3:
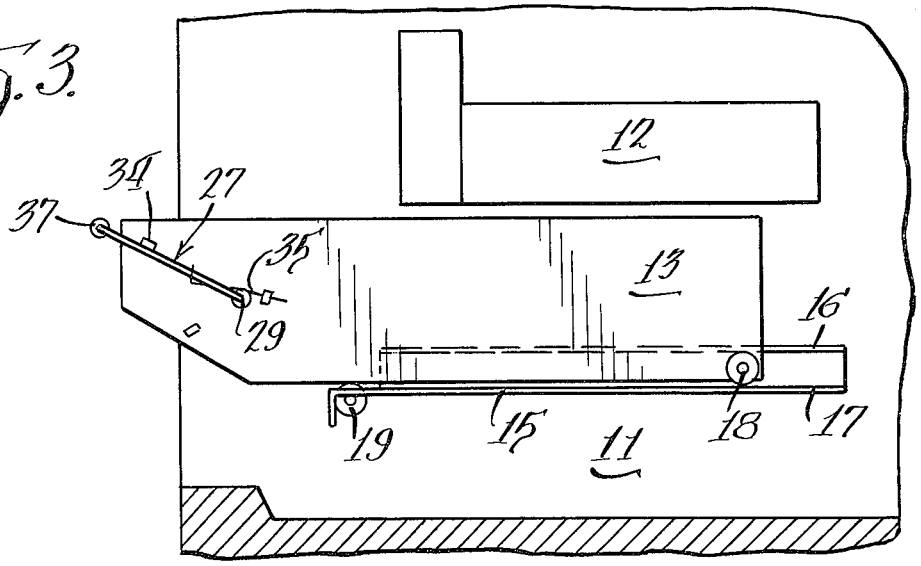
FIG. 3 is a fragmentary side elevational view partially in section illustrating the relationship of the partially projected ice receptacle to the ice maker after the main access door has been opened to expose the access opening.

This invention therefore provides a magnetic connection between the horizontally movable receptacle 13 and the ice receptacle or secondary door 24 so that when this secondary door or the main door 21 is opened the ice receptacle is projected forwardly. This distance of projection is greater when the secondary door 21 is opened as shown in FIG. 2 because this door is customarily only opened for removal of ice from the receptacle 13. The smaller degree of movement of the receptacle when the main door 21 is opened is illustrated in FIG. 3 and this smaller forward movement 46 is limited by the fact that the magnet 36 progressively breaks loose from the armature 37 beginning substantially with the beginning opening movement of the main door 21.

The same movements of the doors returns the ice receptacle to its storage position as illustrated in FIG. 1. This is brought about by the spring 35 holding the interconnecting bail 27 in elevated position against the pair of side stops 34 so that the armature is in position to be engaged by the magnet and push the receptacle rearwardly when either the secondary door 24 or the main door 21 with the secondary door in closed position are returned to closed positions.

As can be seen from a comparison of FIGS. 1 and 2 magnetic armature 37 remains in engagement with the magnet 36 through the full 90° of movement of the secondary door 24. This is achieved because the armature 37 is in the form of a roller which is free to rotate about the horizontal part 32 of the bail 27, and because the bail permits the armature to follow magnet 36 over the path which it takes as the secondary door 24 is opened.

Having described my invention as related to the embodiment shown in the accompanying drawings, it is my intention that the invention be not limited by any of the details of description, unless otherwise specified, but rather be construed broadly within its spirit and scope as set out in the apended claims.

Having described the invention, the embodiments of the invention in which an exclusive property or privilege is claimed are defined as follows:

1. A cabinet apparatus, comprising:

means forming a storage compartment having an access opening;

a main closure member movable about a main axis for exposing and closing said opening, said main closure member having a secondary access opening therein to said compartment; a secondary closure member mounted on said main closure member and movable about a second axis for exposing and closing said secondary opening;

a receptacle in said compartment;

means mounting said receptacle for movement outwardly relative to said compartment thereby projecting partially from said compartment through said access openings when either of said openings is exposed; and interconnecting means interconnecting said receptacle and said secondary closure member for effecting movement of said receptacle when either of said access doors are opened, said interconnecting means effectively breaking the connection of said receptacle to said secondary closure member after a relatively shorter movement of said receptacle on movement of said main closure member about said main closure member axis.

2. The apparatus of claim 1 wherein said storage compartment comprises a freezer compartment of a refrigerator device, said main closure member comprises a freezer door hingedly mounted for movement about said main axis, said secondary access opening comprises a smaller opening in said door and said secondary closure member comprises a smaller door hingedly mounted about said second axis.

3. The apparatus of claim 1 wherein said second axis is asymmetric and non-parallel to said main axis.

4. The apparatus of claim 1 wherein said main axis and second axis are at substantially right angles to each other.

5. The apparatus of claim 4 wherein said main axis is substantially vertical and said second axis is substantially horizontal.

6. The apparatus of claim 1 wherein said means interconnecting said receptacle comprises magnetic means including a hinged member interconnecting the receptacle and said secondary closure member, said magnetic means arranged to magnetically release said hinged member from said secondary closure after a relatively smaller degree of opening movement of said main closure member about its said main axis.

7. The apparatus of claim 1 wherein said interconnecting means comprises a connecting member hingedly mounted on said receptacle at a forward portion thereof and having a portion extending beyond the receptacle toward said secondary closure, an elongated magnetic armature carried by said connecting member and a magnet on said secondary closure member for magnetically engaging said armature.

8. The apparatus of claim 7 wherein said magnetic means interconnecting said receptacle and said secondary closure member comprises a bail having sides embracing and hingedly connected to the forward portion of said receptacle, a generally horizontal base located beyond the forward end of said receptacle and an elongated magnetic armature mounted on said extended portion and parallel to said secondary closure member.

9. The apparatus of claim 8 wherein said secondary access door is provided with an elongated magnet parallel to and normally engaged by said armature.

10. The apparatus of claim 9 wherein said receptacle at its forward portion is provided with stop means limiting the upward pivoting of said bail when unrestricted and there are provided spring means urging said bail against said stop means.

11. In a cabinet apparatus including means forming a storage compartment having an access opening, a main closure member movable about a first axis for exposing and closing said opening, a secondary closure member mounted to said main closure member and movable about a second axis for exposing and closing a secondary access opening, a receptacle in said compartment, and means for mounting said receptacle for movement outwardly of said compartment through said access openings, the improvement comprising:

elongated magnetic interconnecting means comprising an elongated magnet and an elongated magnetic armature for connecting said receptacle and said secondary closure for concurrent movement as incident movement of said secondary closure about said second axis while releasing said interconnection of said receptacle and said secondary closure upon a relatively shorter movement of said receptacle as incident opening movement of said main closure about said first axis.

12. In a cabinet apparatus including a first closure member movable about a first axis and a second closure member mounted to said first closure for movement about a second axis and a receptacle movably mounted within said cabinet adjacent said second closure for access therethrough, an improved interconnecting means comprising:

a first elongated magnetic interconnecting member carried by said second closure member and a second elongated magnetic interconnecting member carried by said receptacle, said first and second members comprising a magnet and a magnetic armature and being arranged to engage each other during movement of said second closure about said second axis and to disengage as incident initial opening motion of said first closure about said first access.

13. The cabinet apparatus of claim 12 wherein movement of said first closure about said first axis effects movement of said first magnetic interconnecting member along an arcuate path and movement of said second closure about said second axis effects movement of said first magnetic interconnecting member about a second arcuate path which lies in a plane perpendicular to said first path.

14. The cabinet apparatus of claim 13 wherein said second magnetic interconnecting member is movably mounted to permit movement along said first arcuate path while preventing movement along said second arcuate path.

15. The cabinet apparatus of claim 14 wherein said first magnetic interconnecting member comprises a magnet and said second magnetic interconnecting member comprises a magnetic armature hingedly mounted to said receptacle.

* * * * *